US005895325A

United States Patent [19]

Tomey

[11] Patent Number: 5,895,325

[45] Date of Patent: Apr. 20, 1999

[54] APPARATUS FOR TEEING GOLF BALLS

[76] Inventor: Stephen Tomey, 8834 Crown, Livonia, Mich. 48150

[21] Appl. No.: 08/916,116

[22] Filed: Aug. 21, 1997

[51] Int. Cl.[6] ..... A63B 57/00

[52] U.S. Cl. ..... 473/134

[58] Field of Search ..... 473/132–137

[56] References Cited

U.S. PATENT DOCUMENTS

| | | | |
|---|---|---|---|
| 2,675,237 | 4/1954 | Willcox | 473/136 |
| 4,141,558 | 2/1979 | Hoffman | 473/132 |
| 4,181,309 | 1/1980 | Atkinson et al. . | |
| 4,355,811 | 10/1982 | Williams, Sr. . | |
| 4,796,893 | 1/1989 | Choi | 473/137 |
| 4,832,345 | 5/1989 | Monasco . | |
| 4,981,299 | 1/1991 | Petrillo . | |
| 5,052,688 | 10/1991 | Shiau . | |
| 5,078,401 | 1/1992 | Fehrenbach et al. . | |
| 5,282,628 | 2/1994 | Komori et al. | 473/136 |
| 5,351,964 | 10/1994 | Kruger . | |
| 5,464,223 | 11/1995 | Dermott | 473/137 |
| 5,624,325 | 4/1997 | Smith | 473/137 |
| 5,647,805 | 7/1997 | Tarbox, Jr. | 473/132 |

*Primary Examiner*—Steven Wong
*Attorney, Agent, or Firm*—Howard & Howard

[57] ABSTRACT

An assembly (20) for teeing golf balls including a ball hopper (180) for storing multiple golf balls in readiness for dispensation to a ball feeder (182). In turn, the ball feeder (182) channels the golf balls one at a time to a ball ejector (160). The ball feeder (182) includes an anti-jam mechanism (222) for maintaining the flow of golf balls to the ball ejector (160). The ball ejector (160) then transfers the golf ball to a ball receptacle (72, 290) on the end of a track member (32) in a fully retracted position. In turn, a drive mechanism (28) moves the track member (32) rectilinearly from the fully retracted position to an extended teeing position at which point the golf ball is delivered to a tee (26, 274). Having delivered the golf ball, the drive mechanism (28) returns the track member (32) to the fully retracted position at which point the ejector (160) transfers another golf ball to the receptacle (72, 290). A golf ball sensor (142) detects the presence or the absence of the golf ball delivered to the tee (26, 274) to signal the drive mechanism (28) to repeat the cycle.

54 Claims, 8 Drawing Sheets

FIG-3
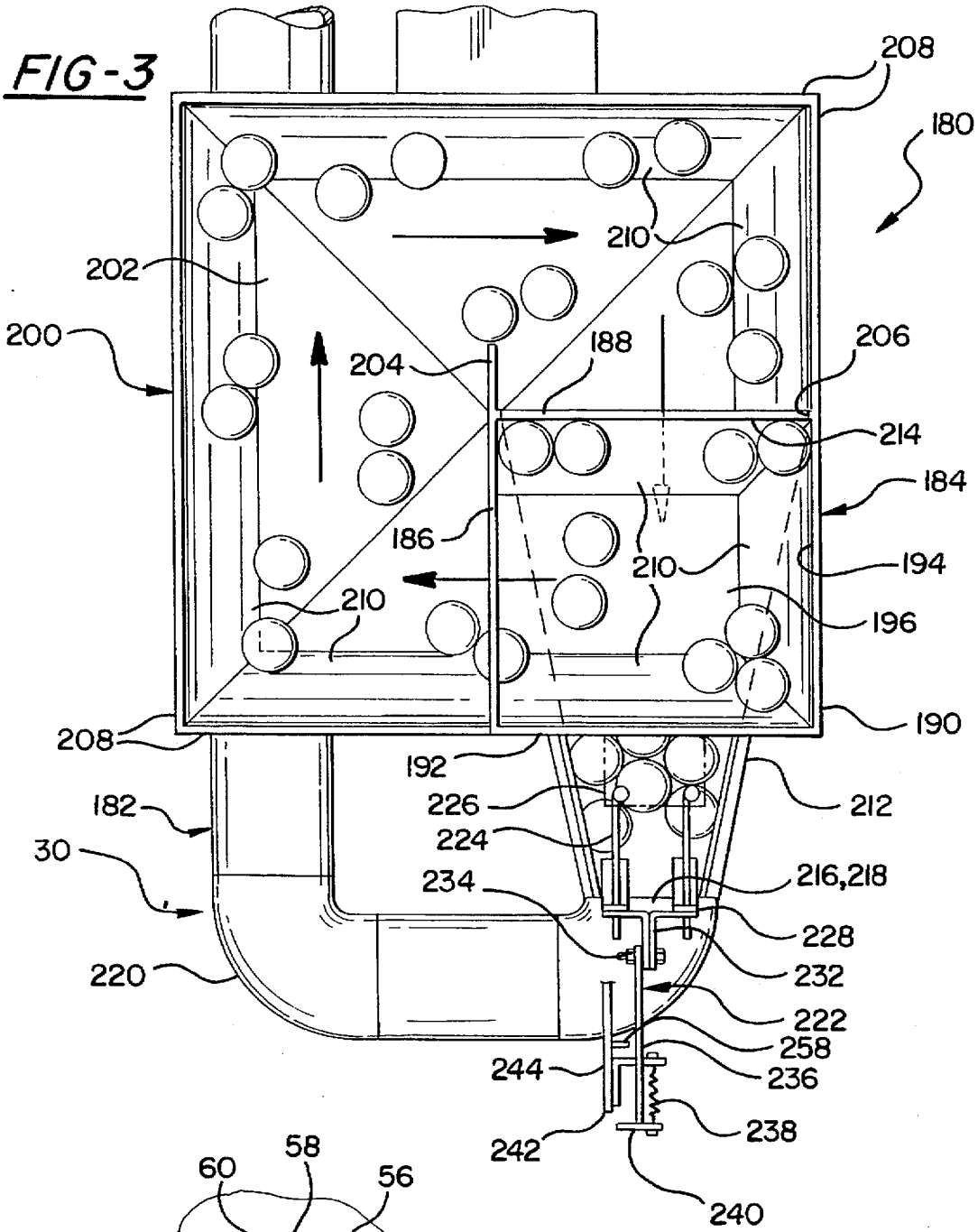
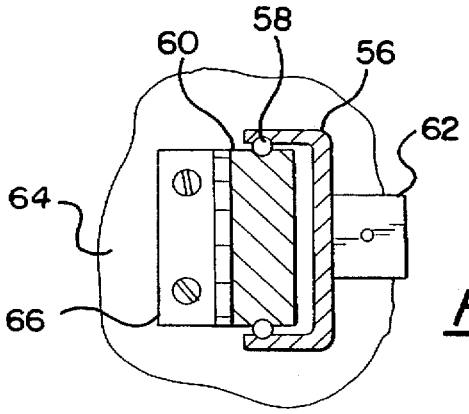
FIG-10

FIG-11
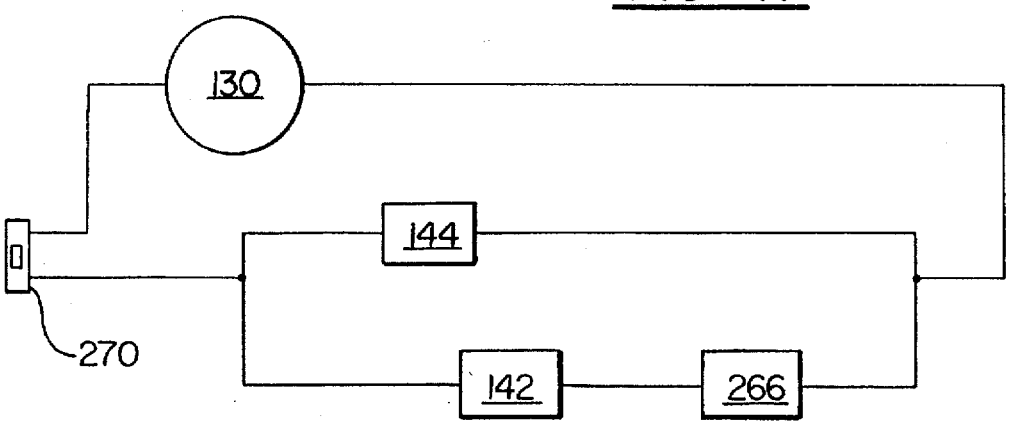
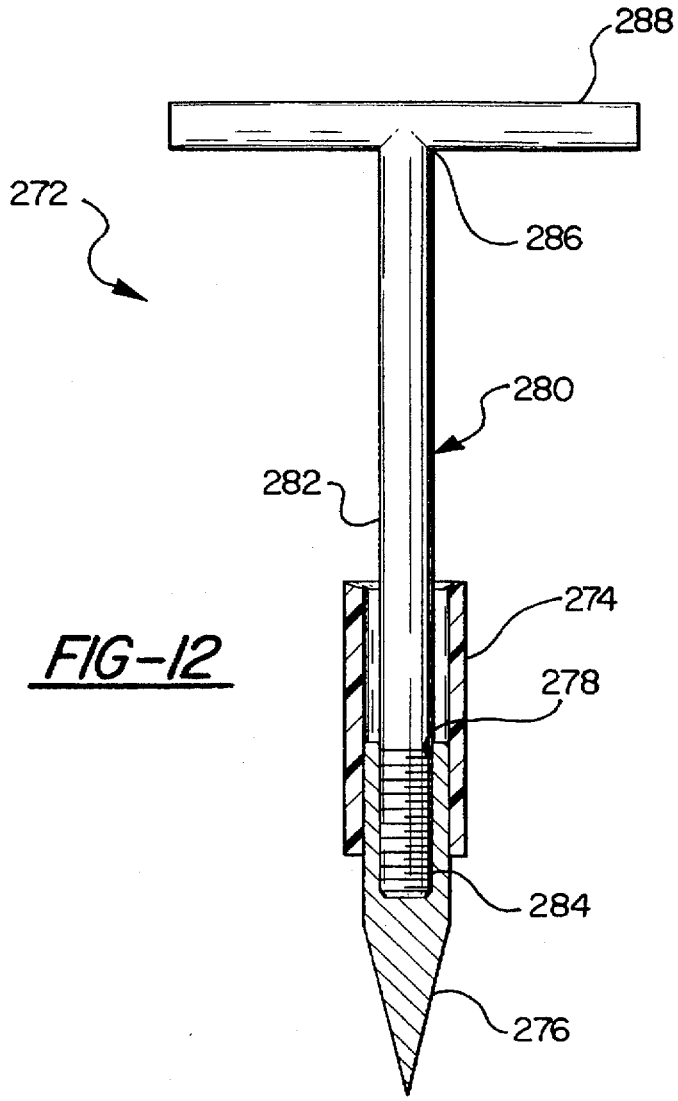
FIG-12

APPARATUS FOR TEEING GOLF BALLS

BACKGROUND OF THE INVENTION

1. Technical Field

The subject invention relates to an automatic golf ball placement apparatus. More specifically, the subject invention relates to an electromechanical assembly for automatically teeing golf balls.

2. Description of the Prior Art

The typical procedure for a golfer practicing hitting golf balls off a tee requires that the golfer each time prior to hitting a golf ball to bend over, pick up a golf ball, move to the tee, place the golf ball on the tee, straighten up, grip a golf club, and set his stance.

Various devices have been proposed by the prior art for automatically teeing golf balls. Typical of such devices is U.S. Pat. No. 5,351,964 to Kruger. However, these types of devices require that the device be permanently installed into a designated hitting venue, i.e., a driving range. In addition, the installation of such devices leads to complicated designs compromising both reliability and cost.

Other prior art devices are asserted as portable and less complicated, such as U.S. Pat. No. 4,981,299 to Petrillo. However, these types of devices are rather bulky in size, and as a result the practicality of moving such a device is severely compromised. Specifically, the Petrillo '299 patent discloses an automatic golf ball teeing assembly including a ball hopper, a transfer mechanism, a delivery mechanism, and a tee. In delivering a golf ball to the tee, the delivery mechanism follows an upward and downward arcuate path. In order to accommodate the movement of the delivery mechanism, the ball hopper, the transfer mechanism, the delivery mechanism and the tee are arranged in series with respect to one another. Accordingly, the overall size of the assembly is relatively large and considerably bulky.

Thus, there is a need for an automatic golf ball assembly which is simple in design, inexpensive, portable and compact.

SUMMARY OF THE INVENTION AND ADVANTAGES

An assembly for teeing golf balls comprising a ball transfer mechanism for transferring one ball at a time to a ball delivery mechanism positioned in a filly retracted position. A drive mechanism for moving the delivery mechanism rectilinearly from the fully retracted position to an extended teeing position for delivering the golf ball from the delivery mechanism to a tee located at the extended teeing position.

The assembly is compact as a result of incorporating the rectilinear motion of the delivery mechanism into the operation of the assembly.

Accordingly, the subject invention provides an automatic assembly for teeing golf balls offering the convenience of eliminating the preparatory motions associated with repeated hitting, as well as, offering the convenience of being easily moved to any venue appropriate for hitting golf balls.

BRIEF DESCRIPTION OF THE DRAWINGS

Other advantages of the present invention will be readily appreciated as the same becomes better understood by reference to the following detailed description when considered in connection with the accompanying drawings wherein:

FIG. 3 is a fragmentary top view of the assembly taken along the line 3—3 of FIG. 2 and in the fully retracted position showing the ball hopper and ball feeder;

FIG. 10 is a cross-sectional view taken along the line 10—10 of FIG. 9 showing the lift member and the lift guide member;

FIG. 11 is a block diagram illustrating the electrical circuit of the assembly;

FIG. 12 is elevation view of an alternative embodiment of a tee assembly with a cross-sectional view through the tee and stake;

DETAILED DESCRIPTION OF THE PREFERRED EMBODIMENT

Figure 1:
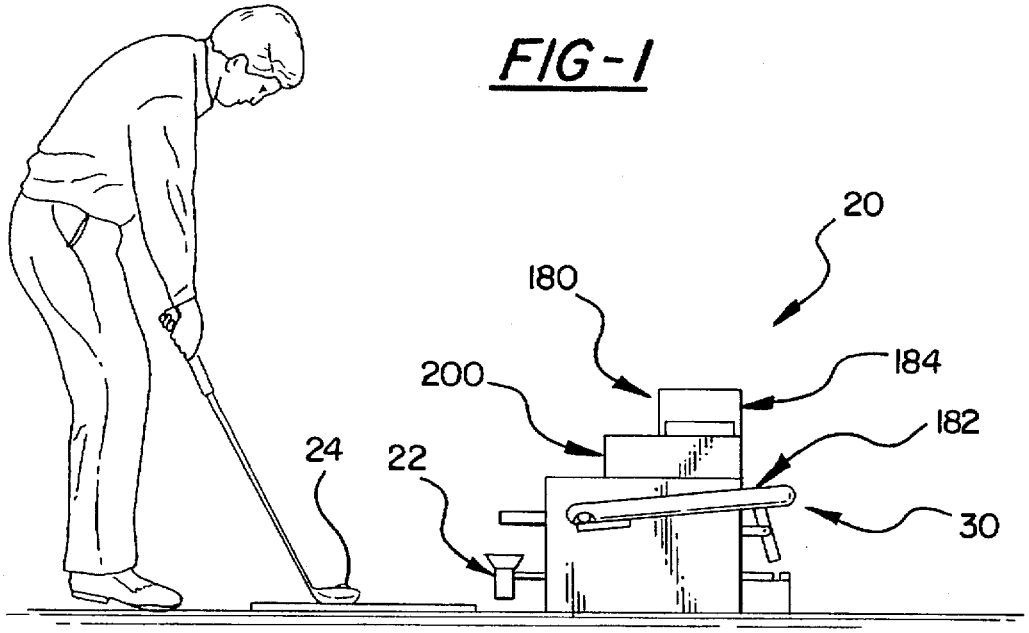
FIG. 1 is an elevation view of the assembly in the fully retracted position in relationship to a golfer in a ready position for striking a golf ball supported on a tee.
Figure 4:
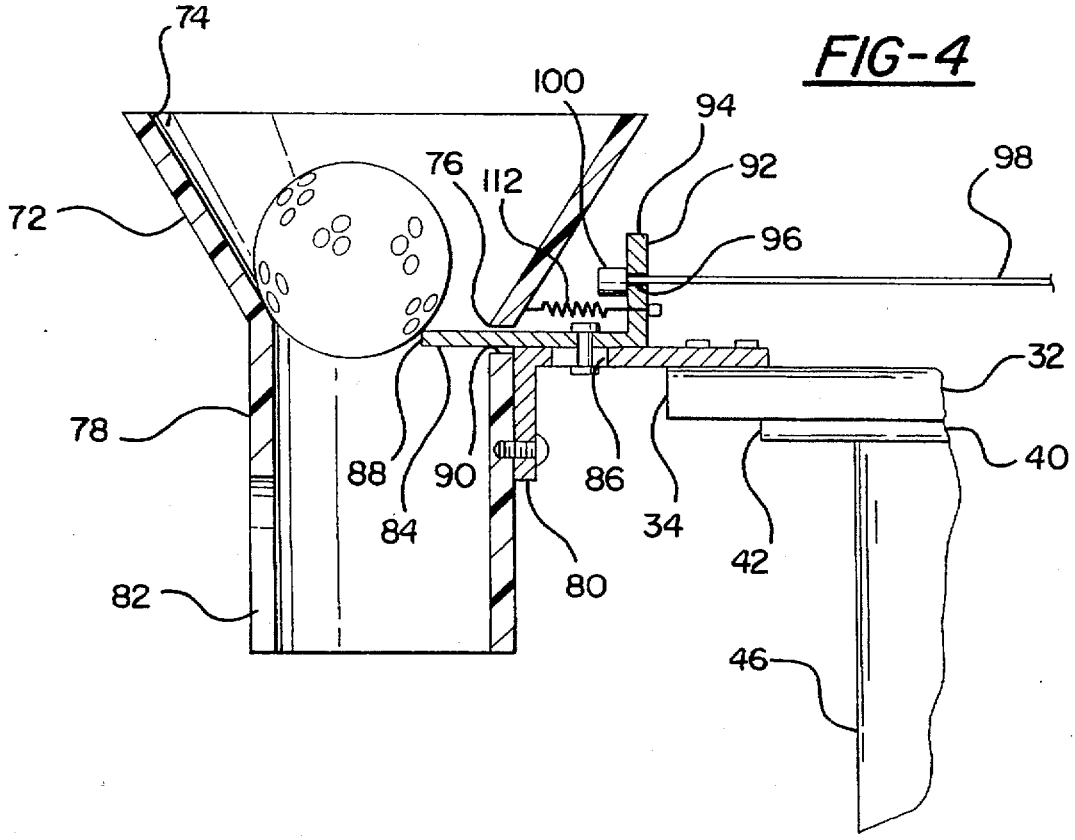
FIG. 4 is a sectional view of the receptacle in the fully retracted position showing the gate in the closed position.
Figure 2:
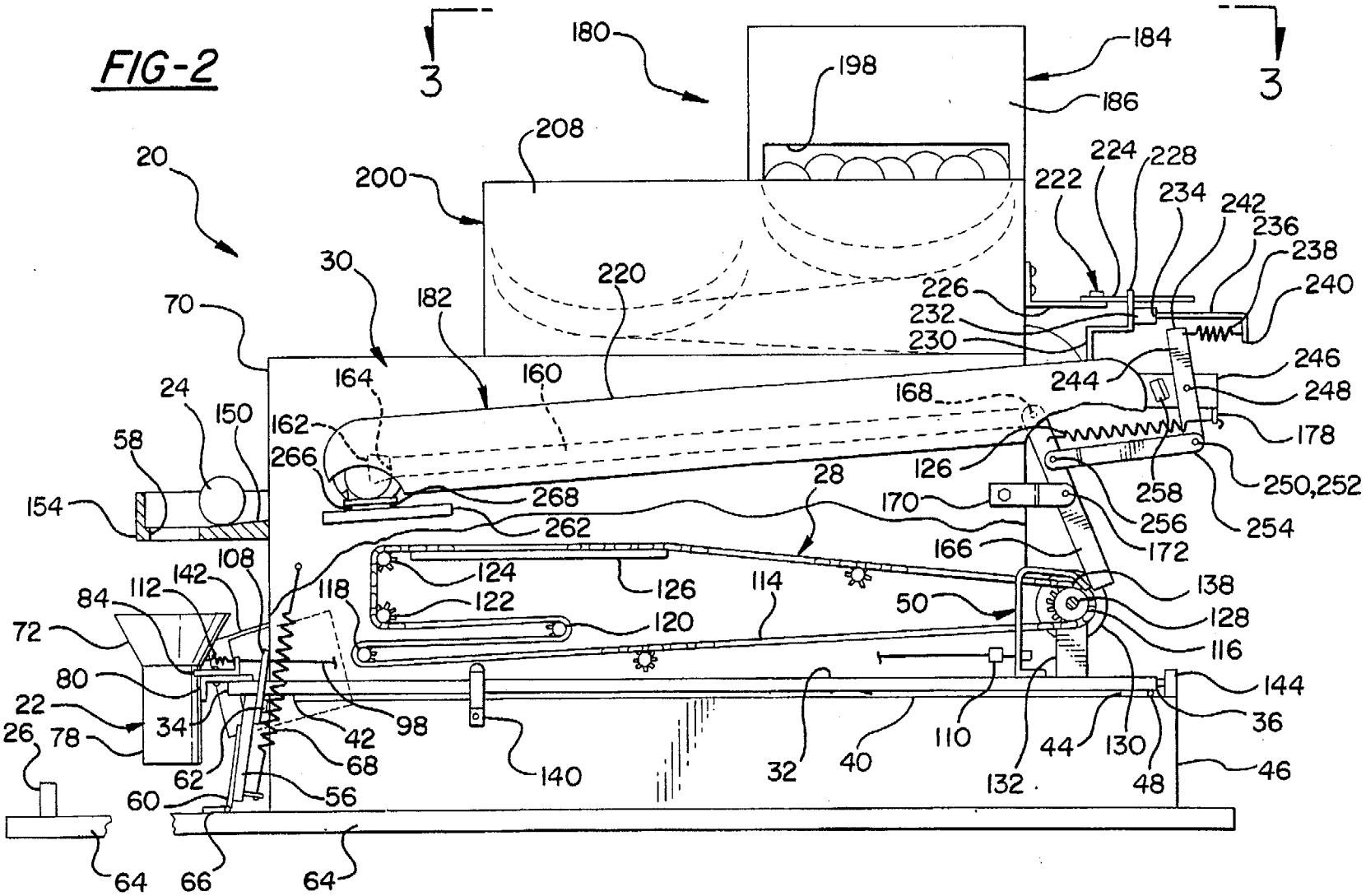
FIG. 2 is a side view of the assembly in the fully retracted position and partially cut away to show the drive belt and track configuration.
Figure 5:
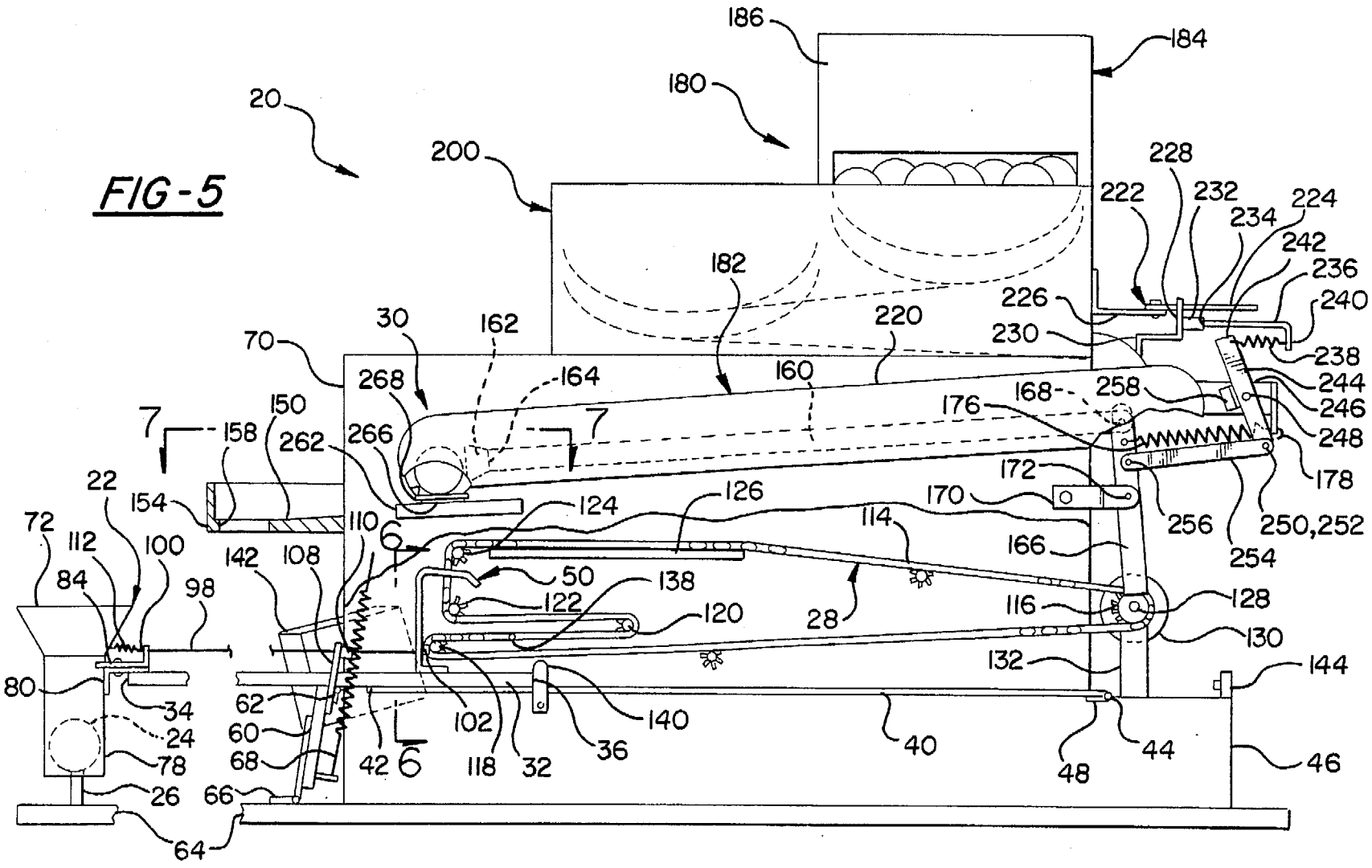
FIG. 5 is a side view of the assembly in the extended teeing position and partially cut away to show the drive belt and track configuration with the drive pin positioned between the belt support members and the first belt guide members.

Referring to the Figures, wherein like numerals indicate like or corresponding parts throughout the several views, an assembly for teeing golf balls is generally shown at 20. The assembly 20 comprises a ball delivery mechanism, generally indicated at 22, for delivering a golf ball 24 to a tee 26 located at an extended teeing position, a drive mechanism, generally indicated at 28, for moving the delivery mechanism 22 rectilinearly between a fully retracted position (FIG. 2) and the extended teeing position (FIG. 5), and a ball transfer mechanism, generally shown at 30, for transferring the golf ball 24 to the delivery mechanism at the fully retracted position.

Figure 6:
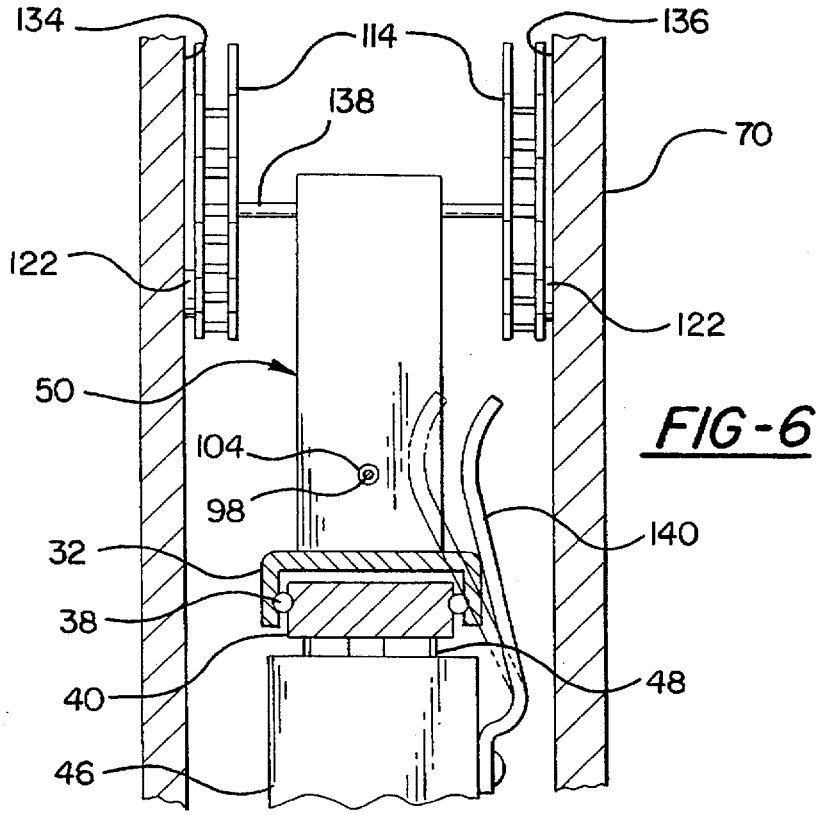
FIG. 6 is a cross-sectional view taken along the line 6—6 of FIG. 5 showing the interface between the movable track member and the locking cantilever in the fully retracted position, and showing in phantom, the interface between the movable track member and the locking cantilever in the extended teeing position.
Figure 9:
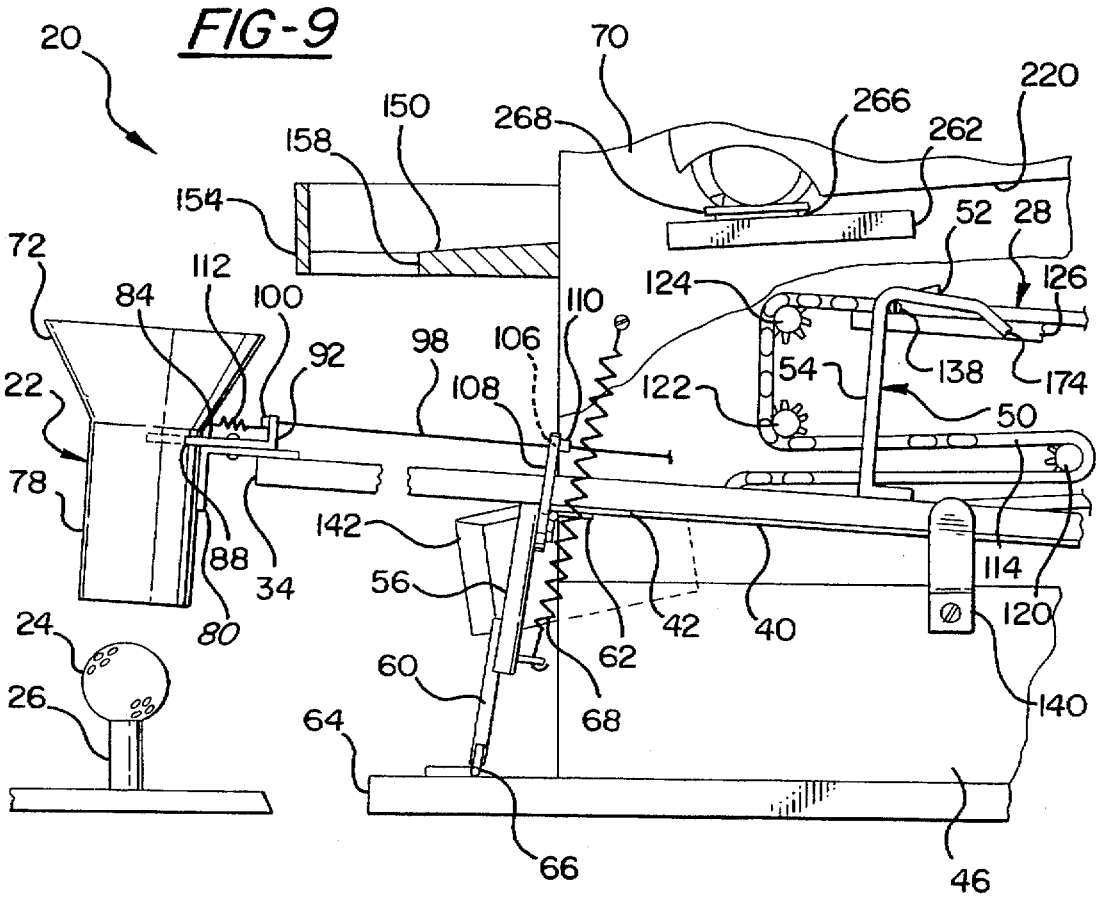
FIG. 9 is a fragmentary side view of the front portion of the assembly in the ball clearing position and partially cut away to show the drive belt and track configuration with the drive pin positioned above the guide bars.

The delivery mechanism 22 includes a movable track member 32 having first and second ends 34 and 36, respectively. The track member 32 is slidably mounted, via roller bearings 38 (FIG. 6), to a track guide rail 40 having first and second ends 42 and 44, respectively. The second end 44 of track guide rail 40 is pivotally mounted to a support platform 46 by a hinge 48. A drive arm, generally indicated at 50, is attached to the track member 32 at a location adjacent to the second end 36 of the track member 32. As best shown in FIG. 9, the drive arm 50 includes a lift arm 52 extending from a substantially vertical arm 54 forming an acute angle between the inner surfaces of the adjoining arms 52, 54. The delivery mechanism 22 further includes a lift member 56 slidably mounted, via roller bearings 58 (FIG. 10), to a lift guide member 60. A hinge 62 interconnects the lift member 56 and the first end 42 of the track guide rail 40. The lift guide member 60 is connected to a support base 64 by a hinge 66 at a location below and adjacent to the first end 42 of the track guide rail 40. A lift spring 68 interconnects the lift member 56 and a support housing 70.

The delivery mechanism 22 further includes a hollow conically shaped receptacle 72 having first opening 74 and second opening 76. The receptacle 72 is located adjacent to the first end 34 of the track member 32. A ball guide tube 78 extends downwardly from the second opening 76 of the receptacle 72. An L-shaped bracket 80 interconnects the guide tube 78 and the first end 34 of the track member 32. The diameter of the guide tube 78 is equal to the diameter of the second opening 76 of the receptacle 72 and is slightly larger than the diameter of a standard sized golf ball. The diameter of the first opening 74 of the receptacle 72 is sufficiently sized to receive a golf ball transferred from the transfer mechanism 30 as described hereinbelow. The length of the guide tube 78 is such that the guide tube 78 encompasses at least half of a golf ball positioned on the tee 26 when the delivery mechanism 22 is in the extended teeing position. The distal end of the guide tube 78 includes a tee slot 82 for allowing the tee 26 to pass through the guide tube 78 when the delivery mechanism 22 moves from the fully retracted to the extended teeing position.

A gate 84 is slidably mounted to the bracket 80 through a bracket slot 86 in the bracket 80, with a first end 88 of the gate 84 passing through a gate slot 90 located adjacent to the proximal end of the guide tube 78. The gate 84 includes a flange 92, located at a second end 94 of the gate 84, having an aperture 96. The delivery mechanism 22 further includes a release member or cable 98 with first 100 and second 102 ends for moving the gate 84 from a closed position to an open position at the extended teeing position. Alternatively, the release cable 98 could consist of a rod, or the like. The first end 100 of the release cable 98 is crimped to the gate 84 through the aperture 96. The second end 102 of the release cable 98 is crimped to the drive arm 50 through an aperture 104 located adjacent to the proximal end of the drive arm 50. The release cable 98 passes through an aperture 106 in a stop arm 108 attached to the lift member 56. A stop tab 110 is crimped to the release cable 98 at a location such that the stop tab 110 engages the stop arm 108 just prior to when the delivery mechanism 22 reaches the extended teeing position. The delivery mechanism 22 further includes a gate closing means or spring 112 interconnecting the receptacle 72 and the gate 84 for moving the gate 84 from the open position to the closed position after the golf ball 24 has been delivered from the delivery mechanism 22.

The drive mechanism 28 includes a pair of parallel drive belts 114 each rotatably supported by a drive wheel 116, a belt support member 118, a first belt guide member 120, a second belt guide member 122, a belt lift member 124, and a belt guide bar 126. The drive belts 114 are metallic chains 114. Alternatively, the drive belts 114 could be smooth or toothed rubber belts, or the like. The drive wheels 116 are sprockets 116, but could be pulleys, or the like. Also, the belt support members 118, the first 120 and second 122 belt guide members, and the belt lift member 124 are sprockets 118, 120, 122, 124, but could be static members having radius contact surfaces, pulleys, or the like. The guide bars 126 are straight members, but could be sprockets, pulleys, or the like. The drive sprockets 116 are secured to the distal and proximal ends a drive shaft 128. The drive shaft 128 is rotatably driven by a drive motor 130 which is mounted to a support bracket 132 fixed to the support base 64. The drive motor 130 is located adjacent to and above the second end 44 of the track guide rail 40. The support sprockets 118 are mounted to opposing first and second inner surfaces 134 and 136, respectively, of the support housing 70. The first guide sprockets 120 are also mounted to the first 134 and second 136 inner surfaces. Similarly, the second guide sprockets 122 are mounted to the first 134 and second 136 inner surfaces. Likewise, the belt lift sprockets 124 are mounted to the first 134 and second 136 inner surfaces. The guide bars 126 are also mounted to the first 134 and second inner 136 surfaces. The support sprockets 118 are located adjacent to and above the first end 42 of the track guide rail 40. The first guide sprockets 120 are located above the support sprockets 118 and between the drive sprockets 116 and the support sprockets 118. The second guide sprockets 122 are located above the first guide sprockets 120 and adjacent to the support sprockets 118. The belt lift sprockets 124 are located adjacent to and above the second guide sprockets 122. The guide bars 126 are located between the belt lift sprockets 124 and the drive sprockets 116. A drive pin 138, for engaging the inner surfaces of the drive arm 50, is secured to each of the drive chains 114, whereby the drive pin 138 is perpendicular to each of the drive chains 114. As can be appreciated, the drive mechanism 28 could alternatively include to a single drive belt rather than a pair of drive belts. Consequently, the drive pin would be secured to the single belt in a cantilever configuration rather than being supported at both ends.

The drive mechanism 28 further includes a track locking means or locking cantilever 140 for preventing the track member 32 from retracting. The locking cantilever 140 is mounted to the support platform 46 at a location adjacent to the first end 42 of the track guide rail 40. At the extended teeing position, a front surface of the locking cantilever 140 engages the second end 36 of the track member 32 preventing the track member 32 from retracting. The length of the locking cantilever 140 is such that the track member 32 disengages the locking cantilever 140 when the track member 32 pivots upward. A side surface of the track member 32 engages an inner surface of the locking cantilever 140 elastically displacing the locking cantilever 140 when the track member 32 pivots downward.

The drive mechanism 28 further includes a ball sensor 142 mounted to an outer surface of the support housing 70. The ball sensor 142 is of a type well known in the art for determining the presence or the absence of an object. The ball sensor 142 is positioned in line with the tee 26 and is calibrated to detect the reflection of the golf ball 24 positioned on the tee 26. Having detected the absence of the golf ball 24, or the lack of the appropriate reflection signal, the ball sensor 142 signals the drive motor 130 to cycle.

The drive mechanism 28 further includes a track position sensor or a track contact switch 144 mounted to the support platform 46 adjacent to the second end 44 of the track guide rail 40. The second end 36 of the track member 32 contacts the track contact switch 144 when the delivery mechanism 22 is in the fully retracted position signaling the drive motor 130 to stop cycling.

Figure 7:
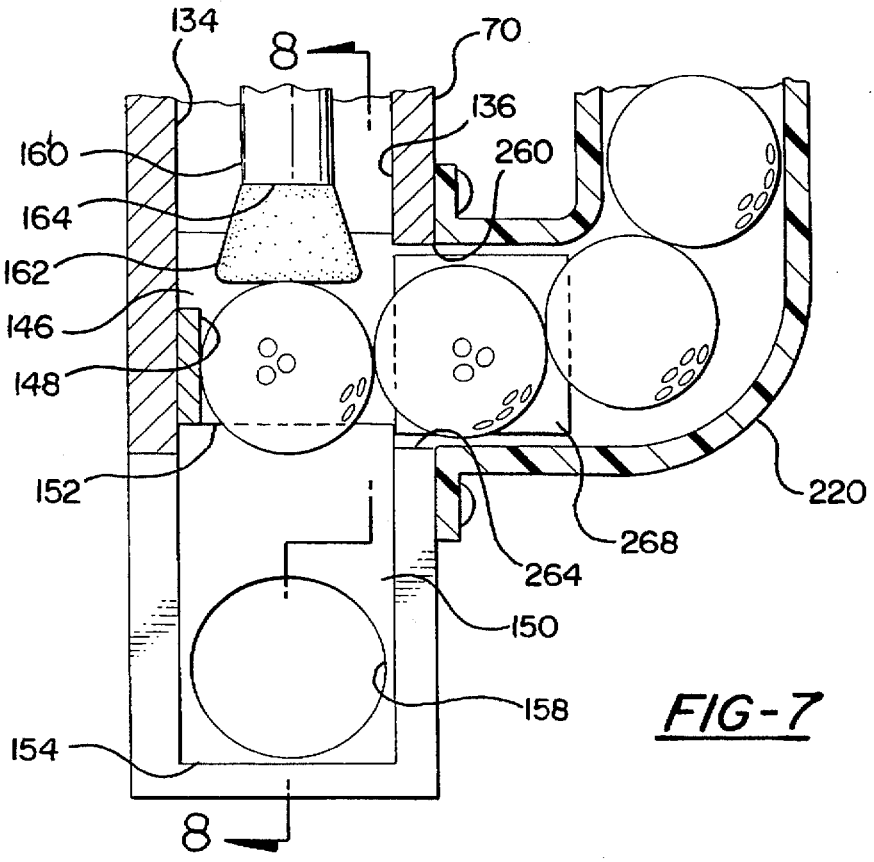
FIG. 7 is a cross-sectional view taken along the line 7—7 of FIG. 5 showing the ejector in the loading position.
Figure 8:
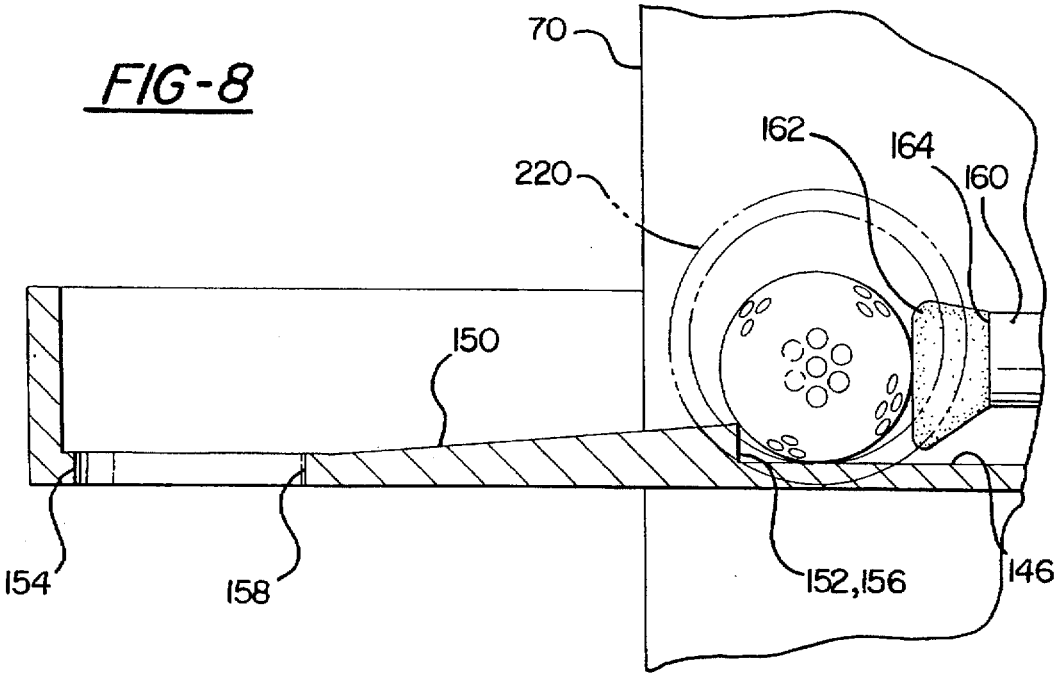
FIG. 8 is a partial sectional view taken along the line 8—8 of FIG. 7.

The transfer mechanism 30 includes a ball staging pad 146 (FIG. 7) for staging a golf ball to be transferred to the delivery mechanism 22. The staging pad 146 is mounted between the inner surfaces 134, 136 of the support housing 70, and is located adjacent to and above the belt lift sprockets 124. A ball stop 148 is mounted to the inner surface 134 of the support housing 70 adjacent to a first end of the staging pad 146 for preventing no more than one golf ball at a time on the staging pad 146. A loading ramp 150 having first and second ends 152 and 154, respectively, extends from the staging pad 146 toward the tee 26. The loading ramp 150 slopes downward from the first end 152 to the second end 154. The first end 152 of the loading ramp 150 forms a lip 156 (FIG. 8) at the adjoining end of the staging pad 146 for holding a golf ball on the staging pad 146. An opening 158 is located adjacent to the second end 154 of the loading ramp 150 for passing a golf ball to the receptacle 72 at the fully retracted position.

The transfer mechanism 30 further includes a ball ejector 160 for transferring a golf ball from the staging pad 146 to the delivery mechanism 22. An ejector foot 162 extends from a first end 164 of the ejector 160. An actuation arm 166 is bolted to a second end 168 of the ejector. The actuation arm 166 is pivotally mounted to an actuation arm support member 170 at a pivot point 172 located adjacent to and below the second end 168 of the ejector 160. The actuation arm 166 extends below the pivot point 172 for engagement with a flange 174 located at the distal end of the drive arm 50 for moving the ejector 160 from a ball loading position to a ball ejection position. A return spring 176 interconnects the actuation arm 166 and a return spring support member 178 for moving the ejector 160 from the ejection position to the loading position.

Furthermore, the transfer mechanism 30 includes a ball hopper, generally shown at 180, for storing and dispensing multiple golf balls to a ball feeder, generally indicated at 182, attached to the hopper 180. The hopper 180 includes a boxed shaped input chamber, generally indicated at 184, having first, second, third and forth walls 186, 188, 190 and 192, respectively. The first wall 186 is perpendicular to the second and forth walls 188, 192, and is parallel to the third wall 190. The top ends of the walls 186, 188, 190, 192 form an inlet opening 194 for inputting a supply of golf balls into the input chamber 184. The second 188, third 190 and forth 192 walls are connected to and partially enclose an input chamber floor 196. The input chamber floor 196 slopes downward from the third wall 190 toward the first wall 186. The first wall 186 includes an opening 198 adjacent to the input chamber floor 196 for feeding golf balls from the input chamber 184 to a supply chamber, generally indicated at 200. The supply chamber 200 includes a L-shaped supply chamber floor 202. The supply chamber floor 202 is connected to the inlet chamber floor 196 at the opening 198 of the first wall 186. An extension wall 204 extends in line with and from the first wall 186 and is connected to the supply chamber floor 202. The supply chamber floor 202 slopes downward wrapping around the extension wall 204 with the lowest portion of the supply chamber floor 202 being adjacent to and below the bottom of the second wall 188. Golf balls exit the supply chamber 200 through an opening 206 formed between the supply chamber floor 202 and the bottom of the second wall 188. Four supply chamber walls 208 are connected to and enclose the perimeter of the supply chamber floor 202 excluding the portion of the perimeter of the supply chamber floor 202 adjacent to the openings 198, 196. Each of the walls 188, 190, 192, 204, 208 connected to a portion of the floors 196, 202 includes a curved surface 210 attached between the base of the wall 188, 190, 192, 204, 208 and the adjoining portion of the floor 196, 202, with the curved surface 210 extending the width of the wall 188, 190, 192, 204, 208. As can readily be appreciated, the curved surface 210 can alternatively be integral to either the adjoining walls or floors, or both.

The ball feeder 182 channels the golf balls fed from the ball hopper 180 to the staging pad 146. The ball feeder 182 includes a funneling ramp 212 located beneath the inlet chamber floor 196. A ramp inlet 214 is connected to the supply chamber floor 202 at the opening 206 located below the second wall 188. A ramp outlet 216 is connected to a staging tube inlet 218 of a staging tube 220. The ball feeder 182 further includes an anti-jam mechanism, generally indicated at 222, for assisting the funneling ramp 212 in channeling the golf balls fed from the hopper 180 into a single file prior to passing the golf balls onto the staging tube 220.

The anti-jam mechanism 222 includes a pair of parallel guide rods 224 attached to a guide rod support member 226. The guide rod support member 226 is mounted to the outside surface of the forth wall 192. The guide rods 224 are located adjacent to and above the ramp outlet 216, with the guide rods 224 being perpendicular to the ramp outlet 216. A pair of guide arms 228, each having a downwardly extending prong 230 or agitation member, are slidably mounted to the guide rods 224. The prongs 230 are spaced apart from each other so that only one golf ball at a time is allowed to pass through the prongs 230. The prongs 230 are interconnected by a crossmember 232. A first end 234 of a push rod 236 is connected to the crossmember 232 for moving the prongs 230 between an aligning position and a resting position. A damping spring 238 interconnects a second end 240 of the push rod 236 and a second end 242 of a driven link 244. The driven link 244 is pivotally mounted to a driven link support member 246 at a pivot point 248 located between the second end 242 and a first end 250 of the driven link 244. The first end 250 of the driven link 244 is connected to a second end 252 of a drive link 254. A first end 256 of the drive link 254 is connected to the actuation arm 166 above the pivot point 172. A stop bracket 258 is mounted to the driven link support member 246 for engagement with the driven link 244 at the alignment position.

The staging tube 220 is downward sloping with the tube inlet 218 being above a tube outlet 260. The tube outlet 260 is located adjacent to the staging pad 146. The staging tube 220 is supported on a support brace 262 connected to the support housing 70 at a location adjacent to tube outlet 260. The support housing 70 includes an opening 264 adjacent to the tube outlet 260 for feeding one golf ball at a time from the tube outlet 260 to the staging pad 146. The diameter of the staging tube 220 is sized to allow a single row of golf balls to flow through the staging tube 220. The routing of the staging tube 220 includes a series of 90° bends and straightaways channeling the golf balls from the tube inlet 218, located behind the staging pad and to one side of the support housing 70, to the opposite side of the support housing 70, and then to the tube outlet 260.

The transfer mechanism further includes a ball supply sensor for signaling the drive motor 130 to stop cycling having detected when the ball feeder 182 has no remaining golf balls to transfer to the staging pad 146. The ball supply sensor includes a ball supply contact switch 266 mounted between the support brace 262 and a ball sensor pad 268. The ball sensor pad 268 is located adjacent to the tube outlet 260 for detecting when there are no available golf balls to be fed to the staging pad 146.

Referring to FIG. 11, the ball sensor 142 and supply contact switch 266 are electrically connected in series. The track contact switch 144 is electrically connected in parallel to the ball sensor 142 and the supply contact switch 266. The drive motor 130 is electrically connected in series with the output of the hereinabove described parallel circuit. A master power switch 270 interconnects the drive motor 130 and input of the described parallel circuit. The ball sensor 142 is set to operate as an open switch having detected the presence of the golf ball 24 on the tee 26. The supply contact switch 266 is normally open and the track contact switch 144 is normally closed.

In the preferred embodiment, the tee 26 is attached to the support base 64. Alternatively, the tee 26 could be completely separate from the assembly 20. In one embodiment, referring to FIG. 12, a tee assembly, generally shown at 272, includes a flexible tee 274 mounted to a stake 276. The stake 276 includes a threaded cavity 278 located in the center of the stake 276. The tee assembly 272 further includes a removable driving tool, generally indicated at 280, having a shaft 282. A first end 284 of the shaft 282 is threaded and fastened to the cavity 278. A second end 286 of the shaft 282 includes a handle 288 having a pair of hand grips extending radially from opposite sides of the center of the shaft 282.

The tee assembly 272 is inserted into the ground at a prescribed teeing position by first manually extending the track member 32 to the extended teeing positioned, then inserting the stake 276 through the center of the guide tube 78, then driving the stake 276 into the ground by pushing on and/or rotating the handle 288, and then removing the tool 280 from the cavity 278 so as to leave the top of the tee 274 exposed.

During operation, the initial setup of the assembly 20 requires a supply of golf balls be fed through the inlet opening 194 of the input chamber 184, and a single golf ball be placed in the receptacle 72 having the delivery mechanism positioned in the fully retracted position. Having inputted a supply of golf balls into the input chamber 184, the golf balls roll down the input chamber floor 196 through the opening 198 in the first wall 186 to the supply chamber 200. In turn, the golf balls roll down the supply chamber floor 202, then through the opening 206 under the second wall 188, and then through the ramp inlet 214. The movement of the golf balls down the input chamber 196 and supply chamber 202 floors is assisted by the curved surfaces 210. The funneling ramp 212 then channels the golf balls so that when they reach the ramp outlet 216 they are aligned into a single file. Having reached the ramp outlet 216, one golf ball at a time passes through the prongs 230 positioned adjacent to the tube inlet 218 in the resting position, and then into the staging tube 220 through the tube inlet 218. The golf balls then proceed to travel in a single file down the staging tube 220 to the tube outlet 260. Having reached the tube outlet 260, the lead golf ball partially passes through the opening 264 in the support housing 70 engaging a side of the ejector foot 162 positioned across the opening 264 in the ejection position. The lead golf ball is currently positioned on the ball sensing pad and is prevented from passing to the staging pad 146.

Having performed the initial setup and assuming the assembly 20 is connected to an appropriate power supply, the master switch 270 is placed in an on position. In the fully retracted position, the track member 32 is in contact with the track contact switch 144 opening the track contact switch 144. Consequently, current is prevented from flowing to the drive motor 130 through the track contact switch 144. Having supplied power to the assembly 20, the ball sensor 142 detects the presence or the absence of a golf ball on the tee 26, 274. Having detected the presence of the golf ball 24, the ball sensor 142 functions as an open switch preventing current from flowing to the drive motor 130 through the ball sensor 142. With both the track contact switch 144 and the ball sensor 142 open, the drive motor 130 will not cycle. Conversely, having detected the absence of the golf ball 24, the ball sensor 142 operates as a closed switch allowing current to flow through the ball sensor 142. In addition, when the track member 32 is in contact with the track contact switch 144, the supply contact switch 266 must also be closed before current can flow to the drive motor 130. The supply contact switch 266 is closed when a golf ball is on the sensing pad 268. Conversely, the supply contact switch 266 is open when there is not a golf ball on the ball sensing pad 268. Accordingly, when the delivery mechanism 22 is in the fully retracted position, the drive motor 130 will only cycle if a ball is on the ball sensing pad 268 and a golf ball is not on the tee 26, 274. Satisfying both of these conditions, current is allowed to flow through the ball sensor 142 and supply contact switch 266 to the drive motor 130.

Having provided current to the drive motor 130, the drive motor 130 rotates the drive shaft 128 clockwise causing the drive sprockets 116 to rotate clockwise. In turn, the drive chains 114 rotate about the drive sprockets 116, the support sprockets 118, the first guide sprockets 120, the second guide sprockets 122, the belt lift sprockets 124, and the guide bars 126. The drive pin 138 moves with the rotation of the drive chains 114. From the fully retracted position, the drive pin 138 initially disengages the flange 174 located at the distal end of the drive arm 50, which causes the force applied to the actuation arm 166 by the drive arm 50 to be removed. In turn, the return spring 176 forces the actuation arm 166 to pivot clockwise about the pivot point 172. As the actuation arm 166 pivots, the flange 174 of the drive arm 50 is moved forward and disengages the actuation arm 166. In turn, the track member 32 disengages the track contact switch 144 closing the track contact switch 144. In turn, current is allowed to flow through the track contact switch 144 to the drive motor 130. Additionally, the clockwise pivot motion of the actuation arm 166 moves the ejector 160 rearward from the ejection position to the loading position. The actual determination of the loading position is further described hereinbelow. Having reached the loading position, the ejector foot 162 moves from across the opening 264 of the support housing 70 allowing the lead ball in the staging tube 220 to pass completely through the opening 264 and onto the staging pad 146. The golf ball positioned on the staging pad 146 engages the ball stop 148 preventing the ball next in line from passing completely through the opening 264.

In addition, the clockwise pivot motion of the actuation arm 166 forces the drive link 254 to move rearward, causing the driven link 244 to pivot counterclockwise. In turn, the counterclockwise pivot motion of the driven link 244 displaces the damping spring 238 placing the damping spring 238 in tension. Provided that the force of the golf balls on the prongs 230 does not exceed the force of the damping spring 238, the damping spring 238 pulls the push rod 236 forward. In turn, the push rod 236 forces the guide arms 228 to slide forward along the guide rods 224 moving the prongs 230 forward from the resting position. The driven link 244 continues to pivot counterclockwise and advance the prongs 230 until the driven link 244 engages the stop bracket 258. At this point, the prongs 230 are positioned in the alignment position.

Additionally, the loading position of the ejector 160 is also determined by the driven link 244 engaging the stop bracket 258. Having engaged the stop bracket 258, the driven link 244 is prevented from pivoting counterclockwise. In turn, the drive link 254 is prevented from moving rearward. In turn, the actuation arm 166 is prevented from pivoting clockwise. In turn, the rearward motion of the ejector 160 ceases. Thus, the ejector 160 reaches the loading position once the driven link 244 engages the stop bracket 258.

The movement of prongs 230 from the resting position to the alignment position assists the funneling ramp 212 in channeling the golf balls into a single file. However, in the event the force of the golf balls pushing on the prongs 230 is greater than the pulling force of the push rod 236, as may be the case when the golf balls within the funneling ramp 212 are stacked upon each another, the forward movement of the prongs 230 ceases. In spite of the lack forward progress of the prongs 230, the driven link 244 will continue to pivot counterclockwise while continuing to displace the damping spring 238. The displacement of the damping spring 238 accounts for the lost motion of the prongs 230. When subjected to this condition, the movement of the driven link 244 is due to the counterclockwise torque on the driven link 244 being greater than the clockwise torque on the driven link 244. This torque imbalance is a result of the spring rate of the return spring 176 being significantly greater than the spring rate of the damping spring 238. The lost motion feature of the damping spring 238 is important to the positioning of the actuation arm 166 and the ejector 160. As described hereinabove, the positioning of the actuation arm 166 and consequently the positioning of the ejector 160 is dependent on the driven link 244 engaging the stop bracket 258. In the event that the driven link 244 does not engage the stop bracket 258, the movement of the actuation arm 166 will stop short of moving the ejector 160 to the loading position. Consequently, the ejector foot 162 will not move rearward enough to clear the opening 264 at the tube outlet 260, preventing the lead golf ball in the staging tube 220 from passing to the staging pad 146.

As the drive pin 138 continues its movement, the drive pin 138 engages the inner surface of the vertical arm 54. The drive pin 138 then advances the drive arm 50 and consequently the track member 32 along a linear path between the drive sprockets 116 and the support sprockets 118. Having reached the forward most surface of the support sprockets 118, the drive pin 138 disengages the drive arm 50. At this point, the track member 32 is positioned in the extended teeing position, with the center of the guide tube 78 being approximately over the center of the tee 26, 274 In addition, having reached the extended teeing position, the locking cantilever 140 engages the second end 36 of the track member 32 preventing the track member 32 from retracting. The operation of the locking cantilever 140 is further described hereinbelow. The tee slot 82 in the guide tube 78 allows the tee 26, 274 to pass into the guide tube 78 as the guide tube 78 moves to the extended teeing position. Just prior to reaching the extended teeing position, the stop tab 110 on the release cable 98 engages the stop arm 108 preventing the gate 84 from moving relative to the track member 32. In turn, as the track member 32 moves to the extended teeing position, the gate 84 moves rearward relative to the receptacle 72 from the closed position to the open position. Having moved the gate 84 to the open position, the golf ball 24 carried by the receptacle 72 passes into the guide tube 78 and onto the tee 26, 274. The guide tube 78 remains at the extended teeing position as the drive pin 138 moves from the support sprockets 118 to and around the first guide sprockets 120, and then to the second guide sprockets 122. During this period of time, the guide tube 78 assists the tee 26, 274 in settling the golf ball 24 onto the tee 26, 274.

As the drive pin 138 travels around the second guide sprockets 122, the drive pin 138 engages the inner surface of the lift arm 52. Having engaged the lift arm 52, the drive pin 138 lifts the drive arm 50 as the drive pin 138 travels from the second guide sprockets 122 to the belt lift sprockets 124. In lifting the drive arm 50, the track member 32 is forced to pivot upward about the hinge 48 interconnecting the guide rail 40 and the support platform 46. In turn, the lift member 56 connected to the guide rail 40 is forced to move upward along an arcuate path. In order to accommodate the movement of the lift member 56, the hinges 62, 66 attached to the lift member 56 and the lift guide member 60 pivot. The lift spring 68 assists in the upward pivoting movement of the track member 32 by applying a pulling force to the lift member 56. As the track member 32 pivots upwards, the guide tube 78 moves upwards away from the golf ball 24 positioned on the tee 26, 274 exposing the golf ball 24 to the ball sensor 142. Having detected the presence of the golf ball 24 on the tee 26, 274, the ball sensor 142 operates as an open switch ceasing the flow of current to the drive motor 130 through the ball sensor 142. The locking cantilever 140 prevents the track member 32 from retracting prior to the guide tube 78 completely clearing the golf ball 24. As the drive pin 138 approaches the belt lift sprockets 124, the guide tube 78 clears the golf ball 24 and then the track member 32 disengages the locking cantilever 140. As the drive pin 138 begins to travel around the belt lift sprockets 124 and toward the guide bars 126, the guide tube 78 begins to move rearward above the golf ball 24. At the same time, the stop tab 110 attached to the release cable 98 disengages the stop arm 108. In turn, the closing spring 112 moves the gate 84 to the closed position. As the drive pin 138 travels over the guide bars 126, the guide tube 78 is held above the golf ball 24 as the guide tube 78 continues to move rearward. In traveling between the rearward ends of the guide bars 126 and the drive sprockets 116, the drive pin 138 moves rearward in a downward sloping manner. As the drive pin 138 moves downward, the lift arm 52 lowers. In turn, the track member 32 pivots downward which forces the lift member 56 to drop displacing the lift spring 68. Consequently, the receptacle 72 and guide tube 78 are lowered. In addition, as the track member 22 pivots downward, the side of the track member 32 engages locking cantilever 140. As the track member 32 continues to descend, the locking cantilever 140 is elastically displaced by the track member 32, arming the locking cantilever 140 for engagement with the second end 36 of the track member 32 at the extended teeing position.

As the drive pin 138 travels around the drive sprockets 116, the flange 174 of the drive arm 50 engages the actuation arm 166. In turn, the drive arm 50 forces the actuation arm 166 to pivot counterclockwise about the pivot point 172. The drive arm 50 continues to pivot the actuation arm 166 counterclockwise until the track member 32 engages the track contact switch 144 opening the contact switch. Having ceased the flow of current through both the track contact switch 144 and ball sensor 142, the drive motor 130 stops cycling. At this point, the track member 32 is repositioned in the fully retracted position, with the receptacle 72 being directly under the opening 158 at the second end 154 of the loading ramp 150.

Additionally, prior to reaching the fully retracted position, the counterclockwise movement of the actuation arm 166 forces the ejector 160 to move forward from the loading position toward the ejection position. In moving to the ejection position, the ejector foot 162 moves the golf ball staged on the staging pad 146 over the lip 156 and onto the loading ramp 150. In turn, the golf ball travels down the loading ramp 150 and through the opening 158 located at the second end 154 of the loading ramp 150. The golf ball then travels through the space between the opening 158 and the receptacle 72 and then into the receptacle 72.

Also, the counterclockwise movement of the actuation arm 166 forces the drive link 254 to move forward, which causes the driven link 244 to pivot clockwise. In turn, the clockwise motion of the driven link 244 removes the tension force of the damping spring 238, and then pushes the push rod 236 rearward. In turn, the push rod 236 forces the guide arms 228 to slide rearward along the guide rods 224 moving the prongs 230 rearward from the alignment position toward the resting position. The prongs 230 reach the resting position when track member 32 is positioned at the fully retracted position and the actuation arm 166 ceases to pivot counterclockwise.

Figure 13:
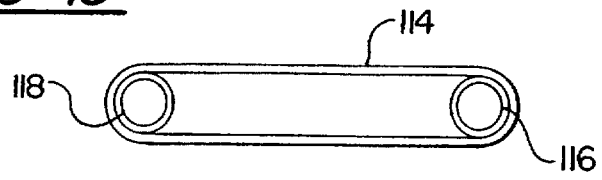
FIG. 13 is a schematic of an alternative embodiment illustrating the drive belts rotatably supported by only the drive wheels and the belt support members.

Referring to FIG. 13, one alternative embodiment is to omit the guide tube. In doing so, the pivoting track and retraction delay features may be eliminated. Consequently, the guide members, the belt lift member and the guide bars can be omitted.

Figure 14:
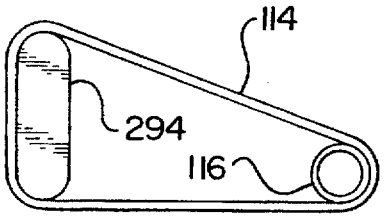
FIG. 14 is a schematic of an alternative embodiment illustrating the drive belts rotatably supported by the drive wheels and the belt support members in which the belt support members incorporate the function of the belt lift members, and the retraction delay feature is eliminated.
Figure 15:
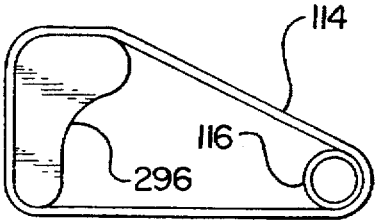
FIG. 15 is a schematic of an alternative embodiment illustrating the drive belts rotatably supported by the drive wheels and the belt support members in which the belt support members incorporate the functions of the belt lift members and the guide bars, and the retraction delay feature is eliminated.

Another alternative embodiment is to eliminate the retraction delay feature while retaining the guide tube. In this embodiment, the first and second guide members are omitted from the drive mechanism. As alternative to this embodiment, the support member could be a support bar 294 having rounded ends, so as to incorporate the lift feature of the belt lift member, as shown in FIG. 14. Thus, the need for a separate belt lift member would be eliminated. As an additional alternative to this embodiment, the support member could be an L-shaped member 296 having rounded ends and a rounded corner, so as to incorporate the functions of the belt lift members and the guide bars, as shown in FIG. 15. Thus, the need for separate belt lift members and guide bars would be eliminated.

Figure 16:
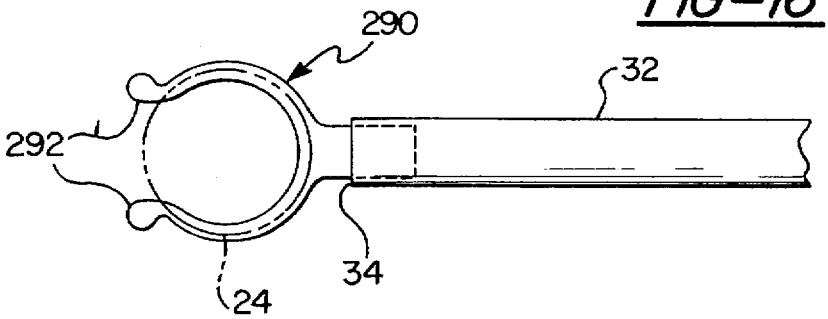
FIG. 16 is a partial top view of an alternative embodiment showing the receptacle and movable track member.
Figure 17:
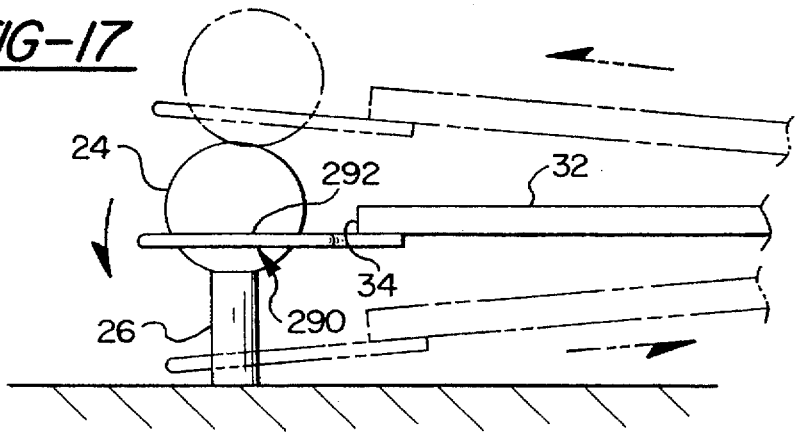
FIG. 17 is a schematic view illustrating the movement of the delivery mechanism in placing a golf ball on the tee of the alternative embodiment depicted in FIG. 16.

Referring to FIG. 16, as additional alternative embodiment, the receptacle could be a claw, generally indicated at 290 having a pair of fingers 292. In this embodiment, the orientation of the drive arm 50 of the preferred embodiment is reversed so that the distal end of the drive arm 50 points toward the first end 34 of the track member 32. In addition, the direction of the rotation of the drive motor 130 of the preferred embodiment is also reversed. Furthermore, as described hereinabove, the first guide member may be omitted if the retraction delay feature is eliminated. In operation, this embodiment operates identical to the preferred embodiment with the exception that the drive pin travels with the drive chains about drive wheels, support member and guide members in reverse order. In turn, the track member 32 pivots downward from the extended teeing position releasing the golf ball 24 onto the tee 26, 274, as shown in FIG. 17.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. An assembly (20) for teeing golf balls comprising:

a ball transfer mechanism (30) for transferring one ball at a time;

a ball delivery mechanism (22) having a fully retracted position for receiving one ball at a time from said transfer mechanism (30);

a drive mechanism (28) for moving said delivery mechanism (22) rectilinearly from said fully retracted position to an extended teeing position for delivering the golf ball from said delivery mechanism (22) at said extended teeing position;

said delivery mechanism (22) including a movable track member (32) having first (34) and second (36) ends;

a ball receptacle (72) attached to said first end (34) of said track member for moving rectilinearly between said fully retracted position and said extended teeing position;

a gate (84) movably disposed in said receptacle (72) for holding a golf ball within said receptacle to said extended teeing position when in a closed position and for delivering the golf ball from said receptacle (72) when in an open position; and a ball release means (98, 108, 110) for moving said gate (84) from said closed position to said open position at said extended teeing position.

2. An assembly (20) as set forth in claim 1 wherein said release means (98, 108, 110) includes a release member (98) having a first end (100) attached to said gate (84) and a second end (102) attached to said second end (36) of said track member (32), and a stop arm (108) located adjacent to said second end (36) of said track member (32) when said track member (32) is at said extended teeing position, and a stop tab (110) attached to said release member (98) for engagement with said stop arm (108) for moving said gate (84) from said closed position to said open position at said extended teeing position.

3. An assembly (20) as set forth in claim 1 including a gate closing means (112) for moving said gate (84) from said open position to said closed position.

4. An assembly (20) as set forth in claim 3 wherein said closing means (112) includes a gate closing spring (112) interconnecting said receptacle (72) and said gate (84) for moving closing said gate (84) from said open position to said closed position.

5. An assembly (20) as set forth in claim 1 including a track guide rail (40) having first (42) and second (44) ends and slidably supporting said track member (32) for moving said receptacle (72, 290) between said fully retracted position and said extended teeing position.

6. An assembly (20) as set forth in claim 5 including a drive belt (114), a drive shaft (128) located adjacent to said second end (44) of said track guide rail (40), a drive wheel (116) being mounted to said drive shaft (128), a belt support member (118) located adjacent to said first end (42) of said track guide rail (40), a drive arm (50) attached to said second end (36) of said track member (32), said drive belt (114) being rotatably supported by said drive wheel (116) and said support member (118), and a drive pin (138) secured to said drive belt (114) for engaging said drive arm (50) for moving said receptacle (72, 290) between said fully retracted position and said extended teeing position.

7. An assembly (20) as set forth in claim 6 wherein said drive mechanism (28) includes a drive motor (130) for rotating said drive shaft (128).

8. An assembly (20) as set forth in claim 7 including a ball guide tube (78) extending downwardly from said receptacle (72) for positioning a golf ball on a tee (26, 274) at said extended teeing position.

9. An assembly (20) as set forth in claim 8 wherein said ball guide tube (78) includes a tee slot (82) for allowing a tee (26, 274) to pass into said ball guide tube (78).

10. An assembly (20) as set forth in claim 6 including a support platform (46) for pivotally supporting said second end (44) of track guide rail (40).

11. An assembly (20) as set forth in claim 10 including a belt lift member (124) located adjacent to and above said support guide member (118) and supporting said drive belt (114) for lifting said guide tube (78).

12. An assembly (20) as set forth in claim 11 including a track locking means (140) for preventing said track member (32) from retracting.

13. An assembly (20) as set forth in claim 12 including a first belt guide member (120) located above said belt support member (118) and between said drive wheel (116) and said belt support member (118) and supporting said drive belt (114), and a second belt guide member located adjacent to and below said belt lift member (124) and supporting said drive belt (114) for momentarily disengaging said drive pin (138) from said drive arm (50) and then reengaging said drive arm (50) with said drive pin (138) when said receptacle (72, 290) is at said extended teeing position.

14. An assembly (20) as set forth in claim 13 including a support base (64), a lift guide member (60) pivotally mounted to said support base (64) below and adjacent to said first end (42) of said track guide rail (40), a lift member (56) connected to said first end (42) of said track guide rail (40) and slidably mounted to said lift guide member (60), and a lift spring (68) operatively connected to said lift member (56) for assisting said drive pin (138) in pivoting said track member (32) upward.

15. An assembly (20) as set forth in claim 14 including a pair of said drive belts (114), a pair of said drive wheels (116), a pair of said belt support members (118), a pair of said first belt guide members (120), a pair of second belt guide members (122), and a pair of said belt lift members (124).

16. An assembly (20) as set forth in claim 1 including a ball sensor (142) for signaling said drive mechanism (28) to cycle having detected the absence of a golf ball (24) on a tee (26, 274) located adjacent to said extended teeing position.

17. An assembly (20) as set forth in claim 1 including a track position sensor (144) for signaling said drive mechanism (28) to stop cycling having detected when said track member (32) is in said fully retracted position.

18. An assembly (20) as set forth in claim 1 wherein said transfer mechanism (30) includes a ball staging pad (146) for staging a golf ball to be transferred to said receptacle (72, 290).

19. An assembly (20) as set forth in claim 18 including an ejector (160) having first (164) and second (168) ends and an ejector foot (162) located at said first end (164) of said ejector (160) for ejecting a golf ball from said staging pad (146).

20. An assembly (20) as set forth in claim 19 including an actuation arm support member (170) and an actuation arm (166) attached to said second end (168) of said ejector (160) and pivotally mounted to said actuation arm support member (170) for moving said ejector (160) from a ball loading position to a ball ejection position.

21. An assembly (20) as set forth in claim 20 including a return spring (176) connected to said actuation arm (166) for pivoting said actuation arm (166) for moving said ejector (160) from said ejection position to said loading position.

22. An assembly (20) as set forth in claim 21 wherein said transfer mechanism (30) includes a ball feeder (182) for channeling the flow of golf balls to said staging pad (146).

23. An assembly (20) as set forth in claim 22 wherein said ball feeder (182) includes a ball anti-jam mechanism (222) for maintaining the flow of golf balls through said ball feeder (182).

24. An assembly (20) as set forth in claim 23 wherein said anti-jam mechanism (222) includes a push rod (236), a crossmember (232), and a pair of prongs (230), said push rod (236) being connected to said crossmember (232) and said crossmember (232) interconnecting said prongs (230) for aligning the golf balls in said ball feeder (182) into a single file.

25. An assembly (20) as set forth in claim 24 including a driven link support member (246), a driven link (244) having first and second ends (250, 242), respectively, said driven link (244) being pivotally mounted to said driven link support member (246), a drive link (254) interconnecting said actuation arm (166) and said first end (250) of said driven link (244), and a damping spring (238) interconnecting said second end (242) of said driven link (244) and said push rod (236) for moving said prongs (230) between an aligning position and a resting position.

26. An assembly (20) as set forth in claim 25 including a guide rod support member (226), a pair of guide rods (224) attached to said guide rod support member (226), and a guide arm (228) extending from each of said prongs (230) and mounted to said guide rod (224) for maintaining the orientation of said prongs (230) in relationship to said ball feeder (182) when said prongs (230) are moved from said resting position to said alignment position.

27. An assembly (20) as set forth in claim 25 including a stop bracket (258) connected to said driven link support member (246) for engagement with said driven link (244) for positioning said actuation arm (166).

28. An assembly (20) as set forth in claim 22 including a ball supply sensor (266) for signaling said drive mechanism (28) to stop cycling when said ball feeder (182) has no remaining golf balls to transfer to said staging pad (146).

29. An assembly (20) as set forth in claim 22 wherein said transfer mechanism (30) includes a ball hopper (180) for storing multiple golf balls in readiness for dispensation to said ball feeder (182).

30. An assembly as set forth in claim 1 including a support base (64) and a tee (26) attached to said support base (64) for receiving a golf ball from said delivery mechanism (22) at said extended teeing position.

31. An assembly (20) for teeing golf balls comprising:

a ball transfer mechanism (30) for transferring one ball at a time;

a ball delivery mechanism (22) for receiving one ball at a time from said ball transfer mechanism (30);

said transfer mechanism (30) including a staging pad (146) for staging a golf ball to be transferred to said delivery mechanism (22);

said assembly (20) characterized by said transfer mechanism (30) including an ejector (160) having first (162) and second (168) ends and an ejector foot (162) located at said first end of said ejector (160) for ejecting a golf ball from said staging pad (146) into said delivery mechanism (22); and an actuation support member (170) and an actuation arm (166), said actuation arm (166 being connected to said second end (168) of said ejector (160) and pivotally mounted to said actuation support member (170) for moving said ejector (160) from a ball loading position to a ball ejection position.

32. An assembly (20) as set fort in claim 31 wherein said delivery mechanism (22) includes a movable track member (32) having first (34) and second (36) ends and a ball receptacle (72, 290) being attached to said first end of said track member (32) for rectilinearly moving said receptacle (72, 290) between a fully retracted position and an extended teeing position.

33. An assembly (20) as set forth in claim 32 including a drive arm (50) attached to said track member (32) adjacent to said second end (36) of said track member (32) for pivoting said actuation arm (166) for moving said ejector (160) from said loading position to said ejection position at said fully retracted position.

34. An assembly (20) as set forth in claim 33 including an ejector return spring (176) connected to said actuation arm (166) for moving said ejector (160) from said ejection position to said loading position.

35. An assembly (20) as set forth in claim 34 wherein said transfer mechanism (30) includes a ball feeder (182) for channeling the flow of golf balls to said staging pad (146).

36. An assembly (20) as set forth in claim 35 wherein said ball feeder (182) includes a ball anti-jam mechanism (222) for maintaining the flow of golf balls through said ball feeder (182).

37. An assembly (20) as set forth in claim 36 wherein said anti-jam mechanism (222) includes a push rod (236), a crossmember (232), and a pair of prongs (230), said push rod (236) being connected to said crossmember (232) and said crossmember (232) interconnecting said prongs (230) for aligning the golf balls in said ball feeder (182) into a single file.

38. An assembly (20) as set forth in claim 37 including a driven link support member (246), a driven link (244) having first (250) and second (242) ends said driven link (244) being pivotally mounted to said driven link support member (246), a drive link (254) interconnecting said actuation arm (166) and said first end (250) of said driven link (244), and a damping spring (238) interconnecting said second end (242) of said driven link (244) and said push rod (236) for moving said prongs (230) between an aligning position and a resting position.

39. An assembly (20) as set forth in claim 38 including a guide rod support member (226), a pair of guide rods (224) attached to said guide rod support member (226), and a guide arm (228) extending from each of said prongs (230), said guide arms (228) being mounted to said guide rods (224) for maintaining the orientation of said prongs (230) in relationship to said ball feeder (182) when said prongs (230) are moved from said resting position to said alignment position.

40. An assembly (20) as set forth in claim 38 including a stop bracket (258) connected to said driven link support member (246) for engagement with said driven link (244) for positioning said actuation arm (166).

41. An assembly (20) as set forth in claim 35 including a ball supply sensor (266) for signaling said delivery mechanism (22) to stop cycling when said ball feeder (182) has no remaining golf balls to transfer to said staging pad (146).

42. An assembly (20) as set forth in claim 35 including wherein said transfer mechanism (30) includes a ball hopper (180) for storing multiple golf balls in readiness for dispensation to said ball feeder (182).

43. An assembly (20) for teeing golf balls comprising:

a ball transfer mechanism (30) for transferring one ball at a time;

a ball delivery mechanism (22) for receiving one ball at a time from said ball transfer mechanism (30);

a ball feeder (182) for channeling the flow of golf balls to said ball transfer mechanism (30);

said ball feeder (182) including an anti-jam mechanism (222) for maintaining the flow of the golf balls through said ball feeder (182);

a driven link (244) having first (250) and second (242) ends with an actuation arm (166) interconnecting said first end of said driven link (244) to said ball transfer mechanism (30) for moving said anti-jam mechanism (222) between an aligning position and a resting position as said ball transfer mechanism (30) transfers the golf balls one at a time; and wherein said anti-jam mechanism (222) includes a push rod (236), a crossmember (232), and an agitation member (230), said agitation member (236) being connected to said crossmember (232) and said crossmember (232) interconnecting said agitation member (230) for aligning the golf balls in said ball feeder (182) into a single file.

44. An assembly (20) as set forth in claim 43 wherein said driven link (244) is pivotally mounted to a driven link support member (246), a drive link (254) interconnects said actuation arm (166) and said first end (250) of said driven link (244), and a damping spring (238) interconnects said second end (242) of said driven link (244) and said push rod (236) for moving said actuation member (230) between said aligning position and said resting position.

45. An assembly (20) as set forth in claim 44 including a guide rod support member (226), a pair of guide rods (224) attached to said guide rod support member (226), and a guide arm (228) extending from each of said actuation member (230), said guide arms (228) being slidably mounted to said guide rods (224) for maintaining the orientation of said actuation member (230) in relationship to said ball feeder (182) when said actuation member (230) are moved from said resting position to said alignment position.

46. An assembly (20) as set forth in claim 44 wherein said delivery mechanism (22) includes a movable track member (32) having first (34) and second (36) ends, and a ball receptacle (72, 290) being attached to said first end of said track member (32) for rectilinearly moving said receptacle (72, 290) between a fully retracted position and an extended teeing position.

47. An assembly (20) as set forth in claim 46 including a drive arm (50) attached to said track member (32) adjacent to said second end (36) of said track member (32) for pivoting said driven link (244) for moving said actuation member (230) from said alignment position to said resting position.

48. An assembly (20) as set forth in claim 47 including an actuation arm support member (170), said actuation arm (166) pivotally mounted to said actuation arm support member (170), and a drive link (254) interconnecting said first end (250) of said driven link (244) and said actuation arm (166) for engaging said drive arm (50) for pivoting said driven link (244) for moving said actuation member (230) between said alignment and said resting positions.

49. An assembly (20) as set forth in claim 48 including a return spring (176) connected to said actuation arm (166) for moving said actuation member (230) from said resting position to said alignment position.

50. An assembly (20) as set forth in claim 49 including a stop bracket (258) connected to said driven link support member (246) for engagement with said driven link (244) for positioning said actuation arm (166).

51. An assembly (20) as set forth in claim 49 wherein said transfer mechanism (20) includes a ball staging pad (146) for staging a golf ball to be transferred to said receptacle (72, 290).

52. An assembly as set forth in claim 51 including an ejector (160) connected to said actuation arm (166) for ejecting a golf ball from said staging pad (146).

53. An assembly (20) as set forth in claim 43 including a ball supply sensor (266) for signaling said delivery mechanism (28) to stop cycling when said ball feeder (182) has no remaining golf balls to transfer to a staging pad (146).

54. An assembly (20) as set forth in claim 43 wherein said transfer mechanism (30) includes a ball hopper (180) for storing multiple golf balls in readiness for dispensation to said ball feeder (182).

* * * * *